United States Patent [19]

Izumi et al.

[11] 4,454,019

[45] Jun. 12, 1984

[54] PROCESS FOR PRODUCING OPTICALLY ANISOTROPIC CARBONACEOUS PITCH

[75] Inventors: Takayuki Izumi, Ohi; Tsutomu Naito, Iruma; Tomoo Nakamura, Sakado; Hisao Tanaka, Ohi, all of Japan

[73] Assignee: Toa Nenryo Kogyo Kabushiki Kaisha, Tokyo, Japan

[21] Appl. No.: 338,590

[22] Filed: Jan. 11, 1982

[51] Int. Cl.[3] ..... C10C 3/00; D01F 9/12; D01F 9/20

[52] U.S. Cl. ..... 208/22; 208/40; 208/39; 423/447.2

[58] Field of Search ..... 208/40, 22; 423/447.2, 423/447.4, 447.6; 264/292

[56] References Cited

U.S. PATENT DOCUMENTS

| | | | |
|---|---|---|---|
| 2,992,181 | 7/1961 | Renner | 208/44 |
| 3,318,801 | 5/1967 | Alexander et al. | 208/40 |
| 3,976,729 | 8/1976 | Lewis et al. | 423/447.4 |
| 4,032,430 | 6/1977 | Lewis | 423/447.1 |
| 4,177,132 | 12/1979 | Uemura et al. | 208/22 |
| 4,188,235 | 2/1980 | Epenscheid et al. | 208/22 |
| 4,209,500 | 6/1980 | Chwastiak | 264/29.2 |

FOREIGN PATENT DOCUMENTS

| | | | |
|---|---|---|---|
| 44214 | 1/1982 | European Pat. Off. | 208/44 |

*Primary Examiner*—Delbert E. Gantz
*Assistant Examiner*—Helane E. Maull
*Attorney, Agent, or Firm*—Joseph J. Dvorak

[57] ABSTRACT

A homogeneous, optically anisotropic pitch used for the production of carbon materials is prepared from a starting oil comprising a substantially chloroform-insoluble matter-free oily or tarry substance. The starting oil is subjected to thermal cracking and polycondensation to form approximately 20-80% of optically anisotropic phase pitch.

38 Claims, No Drawings

PROCESS FOR PRODUCING OPTICALLY ANISOTROPIC CARBONACEOUS PITCH

FIELD OF THE INVENTION

The present invention relates to a process for producing an optically anisotropic carbonaceous pitch suitable for the production of carbon materials such as carbon fibers having a high strength and a high modulus of elasticity. More particularly, the present invention relates to a process for producing an optically anisotropic carbonaceous pitch having a high homogeneity and a low softening point suitable for the prooduction of carbon materials such as carbon fibers used for the production of composite materials having a lightweight, high strength and high modulus of elasticity which comprises thermally cracking and polycondensing a liquid hydrocarbon mixture having a specific composition and structure.

BACKGROUND OF THE INVENTION

In the recent energy-saving and resource-saving age, there have eagerly been demanded low cost, high performance carbon fibers used as a starting material of composite materials having a light weight, high strength and high modulus of elasticity as required for the production of airplanes and motorcars and molding carbon materials having a high strength and high density which can be compression-molded into various products. The present invention provides a process for producing an optically anisotropic carbonaceous pitch having a low softening point, high homogeneity and excellent molecular orientation which can be melt-spun into filaments and which are suitable for the production of the above carbon fibers and molding carbon materials of a high performance.

After intensive investigations on optically anisotropic pitch compositions suitable for the production of high performance carbo fibers as described in the specification of our prior Japanese Patent Application No. 162972/1980, the inventors have found that optically anisotropic pitches have well developed, condensed polycyclic aromatic laminate structure and a high molecular orientation, that in fact, there are various types of optically anisotropic pitches and that among those pitches, pitches having a low softening point and suitable for the production of homogeneous carbon fibers have a specific feature of chemical structures and composition. More particularly, the inventors have found that in the optically anisotropic pitches, compositions, structures and molecular weights of component O (i.e. n-heptane-soluble component) and component A (i.e. n-heptane-insoluble and benzene-soluble component) are quite important. More particularly, the inventors have found that a pitch composition containing specific contents of components O and A can be obtained as a perfect, optically anisotropic pitch and that it is an indispensable condition of an optically anisotropic pitch composition for the practical production of high performance carbon materials to suitably control the balance of the constituents.

It has further been found that if benzene-insoluble components (other than components O and A) in the pitch composition, i.e. benzene-insoluble and quinoline-soluble component (hereinafter referred to as component B) and benzene-insoluble and quinoline-insoluble component (hereinafter referred to as component C) are also specified, an optically anisotropic pitch for the production of a more excellent high performance carbon material can be obtained.

In addition, after investigation on relationships between (1) properties of the respective components and contents thereof and (2) physical properties, homogeneity and orientation of the whole pitch, the inventors have found also that the respective components must be contained therein in specific amounts and that the respective components must have specific properties.

There have been proposed several processes for the production of optically anisotropic carbonaceous pitches suitable for the production of high performance carbon fibers. However, an optically anisotropic carbonaceous pitch comprising components O, A, B and C suitable for the production of carbon materials having a high strength and high modulus of elasticity cannot be obtained by conventional processes. Further, the conventional processes have the following defects:

(1) Starting materials are not easily available on a large industrial scale.

(2) A long reaction time or complicated steps are required and the process cost is high.

(3) If the optically anisotropic phase content is increased to near 100%, softening point of the pitch is elevated to make the spinning difficult. On the other hand, if the softening point is lowered, the pitch becomes heterogeneous and the spinning thereof becomes difficult.

More particularly, in a process disclosed in the specification of Japanese Patent Publication No. 8634/1974, expensive starting materials such as chrysene, anthracene and tetrabenzophenazine which are not available in large amounts are used or complicated steps of dry distillation of tar obtained by cracking a crude oil at a high temperature followed by filtration of unmelted matter at a high temperature are necessitated and, in addition, a spinning temperature as high as 420°–440° C. is required. A process disclosed in the specification of Japanese Patent Laid-Open No. 118028/1975 relates to the conversion of a tar obtained by cracking a crude oil at a high temperature into a heavy product by heating under stirring. In this process, a long reaction time and the removal of unmelted matter are necessitated for obtaining a pitch having a low softening pitch. In the specification of Japanese Patent Publication No. 7533/1978, there is disclosed a process for polycondensing a petroleum tar or pitch in the presence of a Lewis acid catalyst such as aluminum chloride. However, this process is complicated and a high operation cost is required, since the removal of the catalyst and heat treatment before and after the removal are required. A process disclosed in the specification of Japanese Patent Laid-Open No. 89635/1975 comprises thermally polymerizing an optically isotropic pitch under reduced pressure or while an inert gas is introduced in the liquid phase till an optically anisotropic phase content of 40–90% has been attained. The specification of Japanese Patent Laid-Open No. 55625/1979 discloses an optically anisotropic carbonaceous pitch having an optical anisotropic phase content of essentially completely 100%. However, the pitch has considerably high softening point and spinning temperature. The starting materials used in this process are limited vaguely to some commercially available petroleum pitches. If starting materials such as coal tar and petroleum distillation residue are used for the production of pitch in this process, the resulting pitch has an excessive molecular weight. As a result, unmelted matter is formed and the softening point and spinning temperature are elevated to make the spinning difficult. Thus, in the previously proposed processes for the production of optically anisotropic carbonaceous pitch, the composition or structure of the starting materials are not specified and, therefore, according to those processes, it is impossible to stably provide a carbonaceous pitch of a constant high quality.

BRIEF SUMMARY OF THE INVENTION

The present invention relates to a carbonaceous pitch used for the production of a carbon material, particularly carbon fibers. It has been found that the constituents of the optically anisotropic pitch having a high orientation, homogeneity and low softening point and capable of stably melt spinning at a low temperature as required for the production of high performance carbon fibers must have a C/H atomic ratio, fa, number-average molecular weight, maximum molecular weight (molecular weight at a point of 99% integration from the low molecular side) and minimum molecular weight (molecular weight at a point of 99% integration from the high molecular weight side) in specific ranges shown below.

Component O has a C/H atomic ratio of at least about 1.3, fa of at least about 0.80, number-average molecular weight of up to about 1,000 and minimum molecular weight of at least 150. Preferably, component O has a C/H atomic ratio of about 1.3–1.6, fa of about 0.80–0.95, number-average molecular weight of about 250–700 and minimum molecular weight of at least about 150.

Component A has a C/H atomic ratio of at least about 1.4, fa of at least about 0.80, number-average molecular weight of up to about 2,000 and maximum molecular weight of up to about 10,000. Preferably, component A has a C/H atomic ratio of about 1.4–1.7, fa of about 0.80–0.95, number-average molecular weight of up to about 5,000.

Preferred amounts of components O and A are about 2–20wt.% and about 15–45 wt.%, respectively. The optimum amounts of components O and A are about 5–15 wt.% and about 15–35 wt.%, respectively.

If C/H atomic ratio and fa of component O are lower than the above ranges or if amount thereof is larger than the above range, the resulting pitch as a whole is heterogeneous and has a considerable isotropic phase content. If the average molecular weight is larger than 700 or amount of component O is smaller than the above range, it is impossible to obtain the pitch having a low softening point. If C/H atomic ratio or fa of component A is lower than the above ranges or if number-average molecular weight is smaller than the above range, or if amount thereof is larger than the above range, the resulting pitch as a whole has a heterogeneous structure comprising a mixture of the isotropic and anisotropic phases. If the number-average molecular weight or maximum molecular weight is larger than the above range or if amount of component A is smaller than the above range, the pitch cannot have a low softening point, though it is homogeneous and optically anisotropic.

After further investigations, the inventors have found the following facts: Above components O and A are contained in the laminate structure of the optically anisotropic pitch to act as a solvent or plasticizer. Thus, components O and A are concerned with melting properties and fluidity of the pitch. Those components per se hardly develop the laminate structure and have no optical anisotropy. However, if benzene-insoluble components B and C which per se are not molten and which can be laminated easily are added to components O and A in such amounts that the respective components are contained therein in a well-balanced proportion in a specific range and if molecular weights and chemical structures of the respective components are within specific ranges, an optically anisotropic pitch necessary for the production of high performance carbon fibers having a more excellent homogeneity and lower softening point can be obtained.

Namely, it has been found that an optically anisotropic carbonaceous pitch comprising about 2–20 wt.% of component O, about 15–45 wt.% of component A, about 5–40 wt.% of component B (benzene-insoluble, quinoline soluble component) and about 20–70 wt.% of component C (benzene-insoluble, quinoline-insoluble component) and having an optically anisotropic phase content of at least about 90 vol.% and a softening point of up to about 320° C. is capable of forming carbon fibers having a more stabilized, high performance.

For the production of the optically anisotropic pitch having a high orientation, homogeneity and low softening point and capable of stable melt-spinning at a low temperature as required for the production of high performance carbon fibers, components B and C must have a C/H atomic ratio, fa, number-average molecular weight and maximum molecular weight (molecular weight at a point of 99% integration from the low molecular side) within the following ranges:

Component B (benzene-insoluble, quinoline-soluble component) has a C/H atomic ratio of at least about 1.5, fa of at least about 0.80, number-average molecular weight of up to about 2,000 and maximum molecular weight of up to 10,000. Preferably, component B has a C/H atomic ratio of about 1.5–1.9, fa of about 0.80–0.95 and number-average molecular weight of about 800–2,000. Component C (benzene-insoluble, quinoline-insoluble component) has a C/H atomic ratio of up to about 2.3, fa of at least 0.85, estimated number-average molecular weight of up to about 3,000 and maximum molecular weight of up to 30,000. Preferably, component C has a C/H atomic ratio of about 1.8–2.3, fa of about 0.85–0.95 and number-average molecular weight of about 1,500–3,000.

Amount of component B is about 5–55 wt.%, preferably about 5–40 wt.%. Amount of component C is about 20–70 wt.%, preferably about 25–65 wt.%.

A main object of the present invention is to provide a process for efficiently producing an optically anisotropic carbonaceous pitch suitable for the production of carbon fibers of a high modulus of elasticity.

Another object of the present invention is to provide a process for producing an optically anisotropic carbonaceous pitch suitable for the production of a carbon material having a high strength and a high modulus of elasticity, which comprises components O, A, B and C having specific compositions, structures and molecular weights.

Still another object of the present invention is to provide a process for producing an optically anisotropic carbonaceous pitch having a low softening point, high homogeneity and excellent molecular orientation which can be melt-spun stably at a considerably low temperature.

DETAILED DESCRIPTION OF THE INVENTION

It has been difficult in the prior art (excluding catalyzed processes) to produce an optically anisotropic pitch having a sufficiently low softening point and a high homogeneity which can be spun stably.

In the conventional processes wherein heavy hydrocarbons are thermally cracked and polycondensed at a temperature of about 400° C. for a long period of time in substantially one step, the optically anisotropic phase content is gradually increased and, simultaneously, softening point of the whole pitch and accordingly the melt-spinning temperature are also elevated. If the reaction is stopped when a suitable spinning temperature has been attained, the resulting pitch has a heterogeneous composition comprising optically anisotropic phase and large moiety of optically isotropic phase. As a result, the spinning cannot be carried out satisfactorily.

If the reaction is allowed to proceed further until an optically anisotropic phase content of substantially 100% has been attained, the resulting pitch has a quite high softening point unless the starting material is selected very carefully. Other problems in such a case are that a long reaction time is required and that a pitch of a high quality cannot be obtained with a high reproducibility. Thus, the stable spinning on an industrial scale is difficult. As a result, it is impossible to obtain high performance carbon fibers.

Reasons why the above problems are posed in the prior art are as follows: Though it is quite important for obtaining an excellent pitch to select a starting material, techniques of the selection have been unsatisfactory in the prior art. A starting material to be subjected to the thermal cracking and polycondensation reaction has not been selected so as to realize well-balanced development of the planar structure and increase in molecular weight. Namely, this problem is caused because the starting material is not selected so as to realize a sufficiently developed planar structure of the molecules while the molecular weight is not so highly increased and the softening point is sufficiently low. The inventors studied a relationship between properties of the starting material and properties of the pitch for the purpose of obtaining a pitch comprising a substantially homogeneous, optically anisotropic phase having a sufficiently low softening point, i.e. an optically anisotropic carbonaceous pitch comprising components, O, A, B and C having the above mentioned, specific compositions, structures and molecular weights suitable for the production of carbon materials having a high strength and high modulus of elasticity. In the study, various starting heavy oils containing main components having a boiling point in the range of about 250°–540° C. obtained from petroleum and coal were used. Among them, heavy oils substantially free of chloroform-insoluble matter were used as they were and those containing chloroform-insoluble matter were used after filtrating or extracting chloroform-soluble fractions. Then, the oil was fractionated into n-heptane-insoluble component (i.e. asphaltene) and n-heptane-soluble fraction. The n-heptane-soluble fraction was further fractionated into saturated fraction, aromatic oil fraction and resin fraction according to column chromatography. The fractionation was carried out by Iijima's method [Hiroshi Iijima, "Journal of Japan Petroleum Institute" 5, (8), 559 (1962)]. This fractionation method comprises dissolving a sample in n-heptane, fractionating an n-heptane-insoluble matter as asphaltene, pouring an n-heptane-soluble fraction in a chromatographic column charged with active alumina, allowing the same to flow through the column, and eluting the saturated fraction with n-heptane, aromatic oil fraction with benzene and finally resin fraction with methanol-benzene. Intensive investigations were made on properties of the constituents of the starting oil comprising the above saturated fraction, aromatic oil fraction, resin fraction and asphaltene fraction and also properties such as physical properties, homogeneity and orientation of the pitch produced from the starting material having the above properties. After the investigations, the inventors have found that, for the production of an optically anisotropic pitch having a high orientation, high homogeneity and low softening point which can be spun stably at a low temperature for high performance carbon fibers, it is quite important that the above three components, i.e. aromatic oil, resin and asphaltene [hereinafter, those three components will be referred to as non-saturated components (components constituting the starting oil excluding saturated components such as paraffin hydrocarbons)], each have a sufficiently high fa value (ratio of carbon atoms in the aromatic structure to the total carbon atoms determined according to infrared absorption method) and a sufficiently low number-average molecular weight (determined according to vapor pressure equilibrium method) and maximum molecular weight (molecular weight at a point of 99% integration from the low molecular weight side) determined according to gel permeation chromatography. It has also been found that among the above three components, the presence of the aromatic oil and resin is particularly important as main constituents of the starting oil and that proportion of the contents of the above components is not particularly significant. Among the above three components, the presence of asphaltene is not indispensable. However, if asphaltene is contained therein, a homogeneous, optically anisotropic carbonaceous pitch suitable for the production of carbon materials having higher strength and higher modulus of elasticity can be obtained in higher field.

The thermal cracking and polycondensation reaction of the starting oil for the production of the optically anisotropic carbonaceous pitch mainly comprises the thermal cracking and polycondensation of the starting heavy oil to alter the chemical structures of the molecules constituting the pitch. By this reaction, cracking of the paraffin chain structure, dehydrogenation, ring closure and development of the planar structure of the condensed polycyclic aromatic component by the polycondensation are caused. It is considered that molecules having well developed planar structures are associated and aggregated to form a phase, thereby forming the optically anisotropic pitch. It has been found that the saturated component of the starting oil is not so important in specifying the starting material of the present invention, since the saturated component has substantially not characteristic molecular structure and is easily removed from the reaction system due to the thermal cracking which is preferential to the thermal polycondensation. More particularly, the saturated component may be contained in the pitch in an content of about 0–50%. If this content is excessive, the yield of the pitch is reduced and the formation of the optically anisotropic phase is slow requires a long reaction time.

The various oily and tarry substances produced from petroleum and coal contain sulfur, nitrogen, oxygen, etc. in addition to carbon and hydrogen. If those substances containing sulfur, nitrogen, oxygen, etc. in large amounts are used as the starting material, those elements cause the crosslinking or increase in viscosity in the thermal reaction, thereby inhibiting the lamination of the condensed polycyclic aromatic planes. As a result, it becomes difficult to obtain the intended homogeneous, optically anisotropic pitch having a low softening point. A preferred starting material for the production of the intended, optically anisotropic pitch is an oily substance containing carbon and hydrogen as main constituting elements and less than 10% of the sum of sulfur, nitrogen, oxygen, etc. If the starting oil contains inorganic substances or solid, fine particles such as chloroform-insoluble carbon particles, those substances remain in the pitch formed by the thermal reaction. When the pitch is melt-spun, they inhibit the spinning as a matter of course. In addition, the pitch fibers thus spun contain the solid, foreign matter which invites defects. Accordingly, the starting material should substantially not contain chloroform-insoluble matter.

After investigations, the inventors have recognized that a substantially homogeneous, optically anisotropic pitch containing about 90–100% of optically anisotropic phase and having a softening point as low as about 230°–320° C. which could not been attained in the prior art and which pitch can be spun at a sufficiently low melt-spinning temperature of about 290°–380° C. can be obtained by thermally cracking and polycondensing (1) a starting oil obtained from petroleum or coal, having a boiling point of main components in the range of 250°–540° C., substantially free of chloroform-insoluble matter and also free of n-heptane-insoluble matter, wherein the above two non-saturated components (i.e. aromatic oil and resin) have an fa of at least 0.6, preferably at least 0.7, a number-average molecular weight of up to 1,000, preferably up to 750 and a maximum molecular weight of up to 2,000, preferably up to 1,500 or (2) a starting oil obtained from petroleum or coal wherein the above three non-saturated components (i.e. aromatic oil, resin and asphaltene) have an fa of at least 0.6, preferably at least 0.7, a number-average molecular weight of up to 1,000, preferably up to 750 and a maximum molecular weight of up to 2,000, preferably up to 1,500. If asphaltene content of the starting material containing the above non-saturated components (i.e. aromatic oil, resin and asphaltene) as main components is as low as less than 1 wt. %, the presence per se of asphaltene is effective. In such a case, fa, number-average molecular weight and maximum molecular weight of asphaltene are not necessarily within the above mentioned ranges.

In the thermal cracking and polycondensation of the above starting material containing the two or three main components to form the optically anisotropic carbonaceous pitch, the following, various processes may be employed.

The optically anisotropic pitch produced through this invention can be spun at a temperature far lower than a temperature at which the thermal cracking and polycondensation proceed violently. Therefore, decomposed gas formation during the spinning is only slight and conversion into a heavier substance is also slight in the spinning step. Thus, the homogeneous pitch can be spun at a high speed. It has been found that a quite high performance carbon fiber can be obtained in an ordinary manner from this optically anisotropic pitch.

The optically anisotropic pitch obtained by the present invention is characterized in that it satisfies all of three necessary conditions of pitch for the production of high performance carbon fibers, i.e. (1) high orientation (optical anisotropy), (2) homogeneity and (3) low softening point (low melt-spinning temperature).

The definition of the term "optically anisotropic phase" used in this is not necessarily unified or standardized in the art or in literatures. The term "optically anisotropic phase" herein indicates a pitch-constituting phase. In case a section of a pitch mass which has been solidified at nearly ambient temperature is polished and then observed by means of a reflection type polarized light microscope under crossed nicol, the part that a sheen is recognized in the sample when the sample or the crossed nicol is rotated is optically anisotropic. The other part in which the sheen is not recognized is optically isotropic phase.

Unlike the optically isotropic phase, the chemically anisotropic phase contains as principal components molecules having chemical structures having a higher flatness of the polycyclic aromatic condensed rings and, therefore, they are coagulated or associated together to form a laminate of the planes. It is thus considered that the optically anisotropic phase stands in the form of a liquid crystal at its melting temperature. Therefore, if the optically anisotropic pitch is extruded through a thin nozzle in the spinning operation, the planes of the molecules are arranged nearly in parallel with the fiber axis and, consequently, the carbon fibers obtained from the optically anisotropic pitch have a high modulus of elasticity. The quantitative determination of the optical anisotropic phase is effected by taking a polarizing microscopic picture thereof under crossed nicol and measuring an area ratio of the optically anisotropic moiety. This is shown substantially by volume percent.

As for the homogeneity of the pitch, a substantially homogeneous, optically anisotropic pitch herein involves a pitch having an optically anisotropic phase content determined as above of 90–100 vol.% in which solid particles (diameter: larger than 1$\mu$) cannot substantially be detected on the section thereof by the reflection type microscopic observation and which is substantially free of foaming due to a volatile matter at a melt spinning temperature, since such a pitch exhibit a high homogeneity in the actual melt spinning operation.

In the present invention, perfect conversion to 100% anisotropic phase is not always necessary, and 1–10% isotropic microspheres included in anisotropic matrix are satisfactory for substantial homogeneity and even effective for low softening point of the pitch and easy to obtain in the practical process by the present invention.

In case a substantially heterogeneous, optically anisotropic pitch containing more than 10% of the optically isotropic phase is spun, it is a tendency that breaking frequency of the fibers is high, the high speed spinning is difficult, fibers of a sufficient thinness cannot be obtained, filament thicknesses are not uniform and, consequently, high performance carbon fibers cannot be obtained, since the pitch comprises a mixture of the optically anisotropic phase having a high viscosity and a large moiety of optically isotropic phase having a low viscocity. If the pitch contains infusible solid, fine particles or low molecular weight volatile substances, the spinnability thereof is inhibited during the melt spinning operation and the pitch fibers thus obtained contains air bubbles or solid extraneous matters which invite various troubles.

The term "softening point of pitch" herein indicates a temperature at which the solid pitch is converted into liquid pitch. This is determined from a peak temperature of a latent heat absorbed or released when the pitch is molten or solidified measured by means of a differential scanning type calorimeter. This temperature coincides with a temperature determined by ring-and-ball method or micro melting point method with an error of within ±10° C. The "low softening point" herein indicates a softening point in the range of 230°-320° C. The softening point is closely connected with the melt spinning temperature of the pitch. The definition of spinning temperature herein is the maximum temperature of the pitch in a spinning machine required for suitable spinning operation, and, not necessarily the temperature at the spinneret. In the usual spinning method, a fluidity suitable for the spinning is obtained at a temperature 60°-100° C. higher than the softening point in general, though it varies depending on the pitch used. Therefore, if the softening point is higher than 320° C., the spinning temperature is higher than 380° C. at which the thermal cracking and polycondensation occur and, therefore, the spinnability is reduced by the formation of cracked gas and an infusible matter. In addition, the pitch fibers thus obtained contain bubbles and solid extraneous matters which invites troubles. On the other hand, if softening point is lower than 230° C., the infusibilization treatment at a low temperature for a long period of time or complicated, expensive treatment is required unfavorably before carbonization.

The terms "fa", "number-average molecular weight" and "maximum molecular weight" herein have meanings shown below.

The term "fa" herein represents a ratio of carbon atoms in the aromatic structure determined by the analysis of carbon content and hydrogen content and infrared absorption method to the total carbon atoms. The planar structure of molecule is determined by the scale of the condensed polycyclic aromatic moiety, number of naphthene rings, number and length of the side chains, etc. Accordingly, the planar structure of molecule can be discussed on the basis of fa as an index. Namely, fa becomes higher as the condensed polycyclic aromatic moiety is increased, number of naphthene rings is reduced, number of paraffinic side chains is reduced or length of the side chains is reduced. The larger fa value, the higher the planar structure-forming property. fa was measured and calculated according to Kato's method [Kato et al., "Journal of Fuel Association", 55, 244 (1976)]. The term "number-average molecular weight" herein represents a value determined by vapor pressure equilibrium method using chloroform as a solvent. The molecular weight distribution was determined by dividing a sample of the series into 10 fractions according to gel permeation chromatography using chloroform as a solvent, measuring number-average molecular weights of the respective fractions by the vapor pressure equilibrium method and preparing a calibration curve from thus obtained molecular weights of the standard substance of the series. The maximum molecular weight is a molecular weight at a point of 99% integration from the low molecular side of the molecular weight distribution.

The characteristic fa, number-average molecular weight and maximum molecular weight of the three unsaturated components, i.e. aromatic oil, resin and asphaltene, are generally in the order of aromatic oil<resin<asphaltene. In general starting oils, the aromtic oil moiety has the lowest molecular, planar structure-forming property and molecular weight (number-average molecular weight and maximum molecular weight) in the three non-saturated moieties. The resin moiety has a planar structure-forming property and molecular weight higher than those of the aromatic oil moiety and lower than those of asphaltene. Asphaltene has the highest molecular planar-structure-forming property and molecular weight in the three non-saturated moieties. However, the above mentioned order is reversed sometimes.

The description will be made on the relationships between (1) orientation, homogeneity (or compatibility) and softening point of the pitch for the production of high performance carbon fiber and (2) molecular structure of the pitch.

Orientation of pitch is related to the planar structure of the molecule and liquid fluidity at a given temperature. More particularly, necessary conditions for the realization of a high oreintation of pitch are that the pitch molecules have a sufficiently high planar structure and that it has a liquid fluidity sufficient for the rearrangement of the planar surfaces of the molecules along the fiber axis in the melt spinning step.

The planar structure of the molecule becomes more perfect as the condensed polycyclic aromatic moiety is increased, number of naphthene ring is reduced, number of paraffinic side chains is reduced or length of the side chain is reduced. Thus, the planar structure of molecule can be discussed on the basis of fa as index. The large the fa value, the higher the planar structure-forming property.

A liquid fluidity at a given temperature is determined by degree of freeness of molecular and atomic movement. Therefore, it is considered that it can be estimated from molecular weight, i.e. number-average molecular weight and molecular weight distribution (particularly, influence of the maximum molecular weight is significant) as indexes. If fa value is fixed, liquid fluidity at a given temperature is increased as the molecular weight and molecular weight distribution are reduced. The high orientation pitch should have a sufficiently high fa and sufficiently low number-average molecular weight and maximum molecular weight.

Homogeneity of the pitch (or compatibility of the pitch constituents) relates to analogousness of chemical structures and liquid fluidity at a given temperature of the pitch-constituting molecules. And then, like the case of the orientation, the analogousness of chemical structure can be discussed with respect to the planar structure of the molecule on the basis of fa as index and the liquid fluidity can be discussed on the basis of number-average molecular weight and maximum molecular weight as indexes. Therefore, important conditions of a homogeneous pitch are that difference in fa of the pitch-constituting molecules is sufficiently small and number-average molecular weight and maximum molecular weight are sufficiently low.

The softening point is a temperature at which the solid pitch is converted into liquid as described above. Therefore, it is concerned with degree of freeness of the mutual movement of the molecules which regulates the liquid fluidity at a given temperature. The softening point can be estimated from molecular weight, i.e. number-average molecular weight and molecular weight distribution (particularly, influence of the maximum molecular weight is significant) as index. Namely, for attaining a low melt-spinning temperature of the pitch, it is an important condition that the pitch has sufficiently low number-average molecular weight and maximum molecular weight.

The description will be made on the relationships between (1) characteristics of the molecular structure of the starting material and (2) orientation, homogeneity (or compatibility) and softening point of the pitch. The most important condition in the preparation of the intended, optically anisotropic pitch by the thermal cracking and polycondensation of the starting material is that the characteristic planar structure of the condensed polycyclic aromatic molecule and the molecular weight are well-balanced during the reaction. More particularly, the characteristic planar structure and liquid fluidity of the resulting pitch as a whole should be well-balanced in the steps of carrying out the thermal reaction to form the optically anisotropic phase and growing the phase into the homogeneous, optically anisotropic pitch. Namely, it is required that the number-average molecular weight and maximum molecular weight are yet not so high when the sufficient aromatic planar structure have been developed by the thermal reaction. It will be understood, therefore, that in order to realize the above condition, the non-saturated moiety of the starting material should have a sufficiently high molecular planar structure, i.e. fa and relatively, sufficiently low number-average molecular weight and above consideration, the inventors made intensive investigations on the structures of various oily or tarry substances having main components of boiling points of up to about 540° C., thermal reaction conditions and properties of the resulting pitches. After the investigations, the inventors have found the following fact: A homogeneous, optically anisotropic pitch having a low softening point can be obtained by the thermal reaction when the respective three non-saturated components of the starting material (i.e. aromatic oil, resin and asphaltene) have a high fa, sufficiently low number-average molecular weight and maximum molecular weight and, therefore, well-balanced planar structure of the molecule and liquid fluidity of the molecule, more particularly when said three non-saturated components have a fa of at least 0.6, preferably at least 0.7, number-average molecular weight of up to 1,000, preferably up to 750 and maximum molecular weight of up to 2,000, preferably up to 1,500. This fact is recognized either the starting oil comprises two components of aromatic oil and resin or three components of aromatic oil, resin and asphaltene. The present invention has been completed on the basis of this finding.

Particularly when one or both of the aromatic oil and resin components has an fa of below 0.6, it is difficult to obtain the homogeneous, optically anisotropic pitch having a low softening point even if these components have a number-average molecular weight of up to 750 and maximum molecular weight of up to 2,000 for the following reasons: In such a case, the planar structure and liquid fluidity of the molecule are not well balanced. Therefore, the molecular weight is increased before the planar structure of the molecular is sufficiently developed by the thermal reaction and, before the intended, substantially homogeneous, optically anisotropic pitch is attained. If the reaction is further carried out to obtain the substantially homogeneous, optically anisotropic pitch, the resulting pitch has a high softening point of above 320° C.

If one of or both of the two non-saturated components (i.e. aromatic oil and resin) has a number-average molecular weight of above 1,000 or a maximum molecular weight of above 2,000, the homogeneous pitch having a low softening point cannot be obtained, even if the above two components have an fa of above 0.6. Reasons therefor are as follows: High molecular components are easly formed by the thermal reaction and, therefore, liquid fluidity of the resulting pitch is reduced. Thus, even if the substantially homogeneous pitch is obtained, it has a high softening point of above 320° C.

If all or any of the three unsaturated components (i.e. aromatic oil, resin and asphaltene) of the starting oil (excluding a case wherein asphaltene content is very low as described above) has an fa of below 0.6, the homogeneous, optically anisotropic pitch having a low softening point cannot be obtained even if all the three unsaturated components have a number-average molecular weight of below 750 and a maximum molecular weight of below 2,000. Reasons therefor are as follows: Since the planar structure and liquid fluidity of the molecule are not well-balanced, the molecular weight is increased before the planar structure of the molecule is sufficiently developed by the thermal reaction and, therefore, the resulting pitch has a high molecular weight. If the reaction is further carried out to obtain the substantially homogeneous, optically anisotropic pitch, the resulting pitch has a high softening point of about 320° C. If all or any of the three unsaturated components of the starting material has a number-average molecular weight of above 1,000 or a maximum molecular weight of above 2,000, the homogeneous pitch having a low softening point cannot be obtained, even if all the three unsaturated components have an fa of above 0.6. Reasons therefor are as follows: As the thermal reaction proceeds further, components having the too large maximum molecular weight are formed easily. Consequently, liquid fluidity of the resulting pitch is reduced. Therefore, even if the substantially homogeneous, optically anisotropic pitch is obtained, it has a high softening point of above 320° C.

If the oily or tarry substance according to the present invention having the above described, specific properties which have not been disclosed yet in prior art is used as the starting material, the optically anisotropic pitch suitable for the production of carbon materials can be obtained by various methods. This is one of the characteristic features of the present invention. The object of the present invention can be attained by a process wherein the thermal cracking and polycondensation are carried out at a temperature in the range of 380°–460° C., preferably 400°–440° C., under atmospheric pressure while low molecular weight substances are removed under introduction of an inert gas (or under bubbling), a process wherein the thermal cracking and polycondensation are carried out under atmospheric pressure without the circulation of inert gas and then low molecular weight substances are removed by the reduced pressure distillation or heat treatment while an inert gas is introduced therein to remove a low molecular matter or a process wherein the thermal cracking and polycondensation are carried out under pressure and then the product is subjected to the reduced pressure distillation or heat treatment while an inert gas is introduced therein to remove a volatile matter. If the starting material of the present invention is used, the thermal cracking and polycondensation reaction conditions (such as temperature, time, degree of volatile matter removal, etc.) can be selected in borad ranges and the homogeneous, optically anisotropic pitch of a low softening point can surely be obtained. When the oily or tarry starting material of the present invention is used, a particularly preferred process comprises carrying out the thermal cracking and polycondensation under an elevated pressure of 2–50 Kg/mm$^2$ and then carrying out the heat treatment while an insert gas is introduced therein to remove a volatile matter.

In addition to the above described processes wherein the optically anisotropic pitch is obtained by only the thermal cracking and polycondensation reaction step, another process may be adopted for attaining the object of the present invention. In the latter process, the optically anisotropic phase is separated out in the course of the thermal cracking and polycondensation reaction steps.

In the former processes which comprise only the thermal cracking and polycondensation reaction step, the thermal and polycondensation reaction are carried out in substantially only one step. Therefore, the optically anisotropic phase formed in the initial stage is maintained at the high temperature till the completion of the reaction. Consequently, the optically anisotropic phase is apt to have an excessive molecular weight and the pitch is apt to have a relatively high softening point. The latter process wherein the optically anisotropic pitch is separated out in the course of the thermal cracking and polycondensation reaction is preferred, since the excessive increase in molecular weight can be prevented and a substantially homogeneous, optically anisotropic pitch having a low softening point can be obtained. A quite effective process comprises introducing a starting oil or tar having the above characteristic properties of the present invention in a reactor to effect the thermal cracking and polycondensation reaction at a temperature of 380°–460° C. until a pitch (substantially excluding low molecular weight cracked products and unreacted matter) containing 20–80% of optically anisotropic phase has been obtained, allowing the polycondensed pitch to settle at a temperature in the range of 350°–400° C. at which the thermal cracking and polycondensation reaction do not so much proceed and fluidity of the liquid pitch is sufficiently maintained, thereby precipitating the optically anisotropic phase having a high density as a lower continuous phase, allowing the said phaseto grow and to age, and separating this phase from the upper, optically isotropic pitch having a lower density. It is particularly preferred in this process that the thermal cracking and polycondensation reaction are carried out under an elevated pressure of 2–50 Kg/cm$^2$, then the volatile cracked product is removed and the optically anisotropic phase is precipitated to form a lower layer.

Another preferred process comprises using a starting oil having the above described properties of the present invention, subjecting the starting oil to the thermal cracking and polycondensation reaction to partially form the optically anisotropic phase, precipitating the optically anisotropic phase at a temperature at which no rapid increase in molecular weight is caused to obtain a pitch comprising concentrated, optically anisotropic phase and then heat-treating the pitch for a short period of time to obtain a pitch having an optically anisotropic phase content of above 90%.

More particularly, the preferred process comprises using a starting oil or tar having the above described properties of the present invention, subjecting the starting oil to thermal cracking and polycondensation reaction at a temperature of at least about 380° C., preferably 400°—440° C., until optically anisotropic phase content of the polycondensate has reached 20–80%, preferably 30–60%, allowing the polymer to settle at a temperature of below about 400° C., preferably 360°–380° C. for about 5 minutes to a few hours or, alternatively, stirring the mixture very slowly to precipitate the opitically anisotropic pitch of a high density as a lower layer, then roughly separating the lower layer of a high optically anisotropic phase content from the upper layer of a low optically anisotropic phase content and heat-treating thus separated lower layer having an optically anisotropic phase content of 70–90% at a temperature of above about 380° C., preferably 390°–440° C. for a short period of time to obtain the intended pitch having an optically anisotropic phase content of at least 90%.

The optically anisotropic carbonaceous pitch produced by the above processes of the present invention from the above starting material is a substantially homogeneous pitch having an optically anisotropic phase content of 90–100% and a low softening point. The pitch has the following advantages which could not be obtained in the prior art: (1) The optically anisotropic, carbonaceous pitch substantially comprising homogeneous, optically anisotropic phase and having a low softening point (for example, 260° C.) can be obtained in a short period of time (for example, 3 hours in total) without necessitating complicated, expensive steps of high temperature filtration of infusible matter, extraction of solvent and removal of catalyst. Therefore, the pitch can be spun into carbon fibers at a low optimum spinning temperature of 290°–380° C. (2) The optically anisotropic carbonaceous pitch produced by the process of the present invention has a high homogeneity and it can be spun continuously into a fiber of substantially even thickness having a smooth plane at a temperature far lower than about 400° C. at which the thermal cracking and polycondensation proceed violently. Thus, the pitch has excellent spinning properties (low breaking frequency, thinness and evenness) and is free of quality change during the spinning operation. Therefore, quality of the resulting carbon fiber is constant. (3) Cracked gas or infusible matter is substantially not formed during the spinning operation. The pitch can be spun at a high speed. The pitch fiber thus obtained has no serious defect. The carbon fiber has a high strength. (4) The optically anisotropic pitch comprising substantially wholly liquid crystal is spun into fiber. Accordingly, the orientation in the direction of fiber axis in the graphite structure is developed well and the carbon fiber has a high modulus of elasticity. The above, unexpected effects, thus, can be obtained according to the present invention. When carbon fibers were produced from the optically anisotropic pitch produced according to the present invention in an ordinary carbon fiber-producing manner, it was found that the carbon fibers having an extremely high strength and high modulus of elasticity could be obtained stably. The substantially homogeneous, optically anisotropic pitch (optically anisotropic phase content: 90–100%) obtained by the process of the present invention can easily be spun at a temperature of far below 380° C. by a usual melt spinning method with only a low breaking frequency and the fiber thus obtained could be taken up at a high speed. Fibers having a diameter of even 5–10$\mu$ could be obtained.

The pitch fiber obtained from the substantially homogeneous, optically anisotropic pitch produced according to the present invention is infusibilized at a temperature of above 200° C. for about 10 minutes to one hour in oxygen atmosphere. The infusibilized pitch fiber is heated to 1300° C. and carbonized. Thus obtained carbon fiber has characteristic properties which depends on diameter thereof of generally a tensile strength of $2.0–3.7\times10^{\circ}$ Pa, and a modulus in tension of $1.5–3.0\times10^{11}$ Pa. After the carbonization at 1500° C., the fiber has a tensile strength of $2.0–4.0\times10^{9}$ Pa and a modulus in tension of $2.0–4.0\times10^{11}$ Pa.

EXAMPLE 1

A distillate boiling at 480°–540° C. (converted on the basis of atmospheric pressure) obtained by the reduced pressure distillation of a tarry substance by-produced by the catalytic cracking of petroleum was used as a starting material.

The separation of the four components of the starting oil herein was effected by Iijima's method [Hiroshi Iijima, "Journal of Japan Petroleum Institute", 5 (8), 559 (1962)]. More particularly, 2 g of a sample was dissolved in 60 ml of n-heptane. An n-heptane-insoluble matter was fractionated out as asphaltene. An n-heptane-soluble matter was poured in a chromatographic column having an inner diameter of 2 cm and a length of 70 cm and provided with a warm water jacket, in which 75 g of active alumina had been charged (column temperature: 50° C.) and allowed to flow downwards. A saturated component was eluted out with 300 ml of n-heptane, then aromatic oil was eluted out with 300 ml of benzene and finally resin was eluted with methanol/-benzene.

The starting oil did not contain chloroform-insoluble and n-heptane-insoluble matter and had a carbon content of 89.5 wt. %, hydrogen content of 9.3 wt. % and sulfur content of 0.94 wt. %. The starting oil contained 26.9 wt. % of aromatic oil component (separated out in the chromatographic column) having an fa of 0.75, number-average molecular weight of 379 and maximum molecular weight of 650. The starting oil contained 28.2 wt. % of resin having an fa of 0.88, number-average molecular weight of 375 and maximum molecular weight of 820. The saturated component was contained in the starting oil in an amount of 41.9 wt. %. 1,000 g of the starting oil was charged in a heat treatment device and heated to 430° C. for 1.5 hours under stirring in nitrogen gas stream to obtain 14.2 wt. %, based on the starting oil, of a pitch having a softening point of 228° C., specific gravity of 1.32 and a quinoline-insoluble component-content of 15 wt. %. The pitch contained 45% of optically anisotropic spheres having a diameter of up to 200μ in the mother isotropic phase as revealed by the observation by means of a polarized light microscope.

The pitch was charged in a cylindrical reactor having an inner diameter of 4 cm and a length of 20 cm and provided with a drawing cock at the bottom and maintained at 380° C. for one hour under stirring at 30 r.p.m. under nitrogen atmosphere. Then, the cock at the bottom of the reaction vessel was opened under an elevated nitrogen pressure of 100 mmHg to draw 30.5 wt. %, based on the charged amount, of a slightly viscous, lower pitch layer slowly. Then, the drawing was continued until the viscosity of the pitch was lowered remarkably to obtain a boundary pitch between two layers. Therefore, 61 wt. % of the upper pitch layer having a lower viscosity was drawn out.

The upper pitch layer comprised an optically isotropic phase containing about 20% of optically anisotropic spheres having a diameter of up to 20μ. This pitch had a softening point of 214° C., specific gravity of 1.31, quinoline-insoluble matter content of 3 wt. %, carbon content of 93.4 wt. % and hydrogen content of 4.9 wt. %. The boundary pitch had a heterogeneous composition comprising a complicated mixture of the optically isotropic phase containing optically anisotropic spheres having a diameter of up to 20μ in the mother phase and the optically anisotropic phase in the form of masses.

The lower pitch layer had a large flow structure and an optically anisotropic phase content of at least 90%. This lower pitch layer had a softening point of 256° C., specific gravity of 1.34, n-heptane-soluble matter (component O) content of 6 wt. %, n-heptane-insoluble benzene-soluble matter (component A) content of 32 wt. %, benzene-insoluble, quinoline-soluble matter (component B) content of 28 wt. %, quinoline-insoluble matter (component C) content of 34 wt. %, carbon content of 94.9 wt. % and hydrogen content of 4.6 wt. %. The pitch will be referred to as sample 1-1.

The sample was spun as follows and properties of the resulting carbon fibers were examined. The sample was molten in a spinning machine having a nozzle of a diameter of 0.5 mm at a temperature of 340° C. and extruded through the nozzle under a nitrogen pressure of below 200 mmHg under slow stirring and rolled round a bobbin placed below. Thus, a thin pitch fiber could be obtained continuously for a long period of time at a rate of 500 m/min. with only a low breaking frequency and no degradation of the pitch. Thus obtained pitch fiber was made infusible by the treatment in oxygen atmosphere at 230° C. for 30 minutes, then heated up to 1,500° C. at a rate of 30° C./min. in an inert gas and finally allowed to cool to obtain a carbon fiber.

The same starting oil as above was heat-treated in the above heat treatment device at 430° C. for a sufficiently long thermal polycondensation time of three hours to obtain a pitch containing at least 95% of the optically anisotropic phase in a yield of 5.6%. The pitch had a softening point of 302° C., specific gravity of 1.36, component O content of 2 wt. %, component A content of 18 wt. %, component B content of 21 wt. %, component C content of 57 wt. % carbon content of 95.2 wt. % and hydrogen content of 4.4 wt. %. This pitch will be referred to as Sample 1-2.

The above pitch was spun by means of the above spinning machine at 375° C. to obtain a carbon fiber in the same manner as above.

Properties of the pitch and carbon fiber and the spinning conditions are summarized in Table 1.

COMPARATIVE EXAMPLE 1

A heavy oil by-produced in the thermal cracking of naphtha was filtered through a filter and the filtrate was used as the starting oil.

The starting oil is characterized in that substantially the whole constituents thereof have a boiling point in the range of 250°–540° C. under atmospheric pressure, and that it had no chloroform-insoluble matter, a carbon content of 90.6 wt. %, hydrogen content of 8.8 wt. %, sulfur content of 0.77 wt. %, n-heptane-insoluble asphaltene content of 12.1 wt. % which asphaltene had a number-average molecular weight of 1140, maximum molecular weight of 4600 and fa of 0.70, an aromatic oil (separated by the chromatography) content of 53.7 wt. % which oil had a number-average molecular weight of 260, maximum molecular weight of 550 and fa of 0.69, and a resin content of 15.2 wt. % which resin had a number-average molecular weight of 720, maximum molecular weight of 2800 and fa of 0.66. The starting oil had a saturated hydrocarbon content of 18.5 wt. %. 1,000 g of the starting oil was charged in the same heat treatment device as in Example 1 and heat-treated at 415° C. for three hours under stirring in nitrogen gas stream to obtain 108 g of remaining pitch. The pitch had a component O content of 19 wt. %, component A content of 22 wt. %, component B content of 45 wt. % and component C content of 14 wt. %. In the observation by means of a polarized light microscope, it was revealed that though its softening point had already reached 335° C., the optically anisotropic phase content thereof was still less than 50% based on the whole amount. It was impossible to separate the optically anisotropic phase as the lower layer as in Example 1 from the pitch at any temperature. The pitch will be referred to as Sample 2 and used in Example 8.

EXAMPLE 2

A gas oil by-produced in the refining of petroleum and having a boiling point in the range of 300°–450° C. was used as the starting material. The starting oil had a carbon content of 87.7 wt. %, hydrogen content of 10.0 wt. %, sulfur content of 2.1 wt. %, n-heptene-insoluble matter of 0%, aromatic oil (separated in the chromatographic column) content of 44.4 wt. % which oil had an fa of 0.79, number-average molecular weight of 263 and maximum molecular weight of 700, and a resin content of 20.3 wt. % which resin had an fa of 0.83, number-average molecular weight of 353 and maximum molecular weight of 950. The starting oil had a saturated moiety content of 34 wt. %. 600 g of the starting oil was charged in a 1 liter autoclave. After nitrogen gas replacement, the temperature was elevated and the starting oil was heat-treated at 430° C. for three hours under stirring under an elevated pressure of 5 Kg/cm$^2$ while the pressure was regulated by discharging gaseous cracked products of low molecular weights. The resulting pitch was stripped with nitrogen at 380° C. for one hour under atmospheric pressure to obtain 15 wt. %, based on the starting oil, of a pitch having a softening point of 210° C. and quinoline-insoluble matter content of 12 wt. % and containing 60% of optically anisotropic spheres having a diameter of up to 200μ in the optically isotropic mother phase as revealed by the observation by means of a polarized light microscope.

The pitch was maintained at 380° C. for two hours in the same reaction vessel as in Example 1. A viscous, lower pitch layer was discharged in an amount of 35 wt. % based on the charged amount through the cock placed at the bottom of the reaction vessel.

The lower pitch layer had a large flow structure and an optically anisotropic phase content of at least 95 wt. %. This lower pitch layer had a softening point of 285° C., specific gravity of 1.35, component O content of 3 wt. %, component A content of 28 wt. %, component B content of 27 wt. %, component C content of 42 wt. %, carbon content of 93.8 wt. % and hydrogen content of 4.7 wt. %. The pitch will be referred to as Sample 3 and used in Example 8.

EXAMPLE 3

A heavy oil by-produced in the refining of petroleum and comprising main components boiling at 250°–540° C. was filtered through a filter and chloroform-insoluble matter was removed therefrom. Thus treated oil was used as the starting material. The starting oil had a carbon content of 89.27 wt. %, hydrogen content of 8.72 wt. %, sulfur content of 2.2 wt. %, n-heptane-insoluble asphaltene content of 1.4 wt. % which asphaltene had an fa of 0.75, number-average molecular weight of 705 and maximum molecular weight of 1320, an aromatic oil (separated in the chromatographic column) content of 40.0 wt. % which oil had an fa of 0.83, number-average molecular weight of 335 and maximum molecular weight of 910, and a resin content of 7.8 wt. % which resin had an fa of 0.83, number-average molecular weight of 508 and maximum molecular weight of 1270. The starting oil had a saturated hydrocarbon content of 47.3 wt. %. 1,000 g of the starting oil was heat-treated at 415° C. for three hours in the same manner as in Example 1 to obtain a pitch in a yield of 9.3 wt. % based on the starting oil. The pitch had a softening point of 236° C., specific gravity of 1.32 and quinoline-insoluble matter content of 11.9 wt. %. In the observation by means of a polarized light microscope, it was revealed that it comprises about 50% of perfectly spherical, optically anisotropic spheres having a diameter of up to 200μ in the optically isotropic mother phase.

The pitch was maintained at 370° C. for one hour in the same manner as in Example 1. A viscous, lower pitch layer was discharged in an amount of 45 wt. % based on the charged amount through the cock at the bottom of the reaction vessel. The lower pitch layer had a large flow structure and an optically anisotropic phase content of at least 95 wt. %. It had a softening point of 268° C., specific gravity of 1.35, component O content of 2 wt. %, component A content of 39 wt. %, component B content of 25 wt. % and component C content of 34 wt. %. The lower pitch layer will be referred to as Sample 4 and used in Example 8.

COMPARATIVE EXAMPLE 2

For comparison, a phenol-extracted oil comprising main components boiling at 450°–540° C. (under atmospheric pressure) by-produced in a step of producing a lubricating oil from petroleum was used as a starting material. The starting oil contained no chloroform-insoluble matter and had a carbon content of 85.42 wt. %, hydrogen content of 10.27 wt. %, sulfur content of 4.3 wt. %, n-heptane-insoluble matter content of 0%, an aromatic oil (separated in the chromatographic column) content of 76 wt. % which oil had an fa of lower than 0.4, number-average molecular weight of 428 and maximum molecular weight of 960, and a resin content of 9 wt. % which resin had an fa of lower than 0.5, number-average molecular weight of 403 and maximum molecular weight of 1250.

The starting oil was heat-treated at 430° C. for 1.5 hours in the same manner as in Example 1. The resulting pitch had a softening point of 273° C. and quinoline-insoluble matter content of 13% and contained about 20% of optically anisotropic spheres having a diameter of up to 20μ in optically isotropic mother phase as revealed by means of a polarized light microscope. Yield was 9.7 wt. % based on the starting oil.

It was impossible to separate the optically anisotropic phase as the lower layer as in Example 1 from the pitch.

A pitch obtained by the heat treatment at 430° C. for three hours was a heterogeneous pitch comprising a complicated mixture of substantially equal contents of the optically anisotropic phase and optically isotropic phase as revealed by the observation by means of a polarized light microscope. The pitch had component O content of 18 wt. %, component A content of 23 wt. %, component B content of 12 wt. %, component C content of 47 wt. % and a softening point of 355° C. Yield: 7.8 wt. %.

It was impossible to separate the optically anisotropic phase from the pitch by the precipitation in the same manner as in Example 1.

The pitch will be referred to as Sample 5 and used in Example 8.

EXAMPLE 4

A tarry substance by-produced in the catalytic cracking of petroleum was distilled under reduced pressure to a temperature of 540° C. (converted on atmospheric pressure bais). A tarry residue was heat-treated at 430° C. for three hours in the same manner as in Example 1. An oily substance distilled out from the heat treatment device mainly comprising components having a boiling point in the range of 480°–540° C. was used as the starting material. The starting material contained no chloroform-insoluble component and had a carbon content of 93.0 wt. %, hydrogen content of 6.0 wt. %, sulfur content of 0.99 wt. %, n-heptane-insoluble matter content of 7.2% which matter had an fa of 0.91, number-average molecular weight of 520 and maximum molecular weight of 950, aromatic oil (separated in the chromatographic column) content of 59.6 wt. % which oil had an fa of 0.87, number-average molecular weight of 341 and maximum molecular weight of 780, and a resin content of 30.4 wt. % which resin had an fa of 0.91, number-average molecular weight of 430 and maximum molecular weight of 810. The starting material had a saturated hydrocarbon content of 1.1 wt. %.

600 g of the starting oil was heat-treated at 420° C. for 3 hours under pressure in the same manner as in Example 2. The resulting pitch was stripped at 380° C. for two hours under atmospheric pressure to obtain 22.0 wt. %, based on the starting oil, of a pitch having a softening point of 212° C., specific gravity of 1.33 and quinoline-insoluble matter content of 2% and containing about 40% of perfectly spherical, optically anisotropic spheres having a diameter of up to 200μ in the optically isotropic mother phase as revealed by the observation by means of a polarized light microscope.

The pitch was maintained at 380° C. for one hour in the same manner as in Example 1. A viscous, lower pitch layer was discharged in an amount of 10 wt. % based on the charged amount, through a cock at the bottom of the reaction vessel. The lower pitch layer had a large flow structure and almost 100% optically anisotropic phase. It had a softening point of 264° C., specific gravity of 1.35, component O content of 4 wt. %, component A content of 24 wt. %, component B content of 34 wt. % and component C content of 38 wt. %. The pitch will be referred to as Sample 6 and used in Example 8.

EXAMPLE 5

A liquefied tarry substance obtained by cracking of coal was subjected to the reduced pressure distillation. An oil distilled out at 250°–540° C. (converted on atmospheric pressure basis) was used as the starting material. The starting material had a carbon content of 89.7 wt. %, hydrogen content of 7.5 wt. %, n-heptane-insoluble matter content of 0%, aromatic oil content (separated in a chromatographic column) of 51 wt. % which oil had an fa of 0.74, number-average molecular weight of 254 and maximum molecular weight of 560, and a resin content of 23 wt. % which resin had an fa of 0.76, number-average molecular weight of 347 and maximum molecular weight of 840. 1,000 g of the starting oil was heat-treated at 430° C. for two hours in the same manner as in Example 1 to obtain 9.5 wt. %, based on the starting oil, of a pitch having a softening point of 205° C., specific gravity of 1.34 and quinoline-insoluble matter content of 18 wt. % and containing about 60% of perfectly spherical, optically anisotropic spheres having a diameter of up to 200μ in the optically isotropic mother phase as revealed by the observation by means of a polarized light microscope.

The pitch was maintained at 380° C. for one hour in the same manner as in Example 1. A slightly viscous, lower pitch layer was discharged in an amount of 39.0 wt. %, based on the charged amount, through a cock placed at the bottom of the reaction vessel. The lower pitch layer had a large flow structure comprising 100% optically anisotropic pitch. It had a softening point of 272° C., specific gravity of 1.36, component O content of 6 wt. %, component A content of 26 wt. %, component B content of 20 wt. % and component C content of 48 wt. %.

The lower layer pitch will be referred to as Sample 7 and used in Example 8.

EXAMPLE 6

A tarry substance by-produced by catalytic cracking of petroleum was subjected to the reduced pressure distillation. An oil distilled out at 480°–540° C. (converted on atmospheric pressure basis) was used as the starting material. The starting oil contained no n-heptane-insoluble matter and had a carbon content of 89.5 wt. %, hydrogen content of 9.3 wt. %, sulfur content of 0.94 wt. %, aromatic oil (separated in a chromatographic column) content of 26.9 wt. % which oil had an fa of 0.75, number-average molecular weight of 379, maximum molecular weight of 650 and a resin content of 28.2 wt. % which resin had an fa of 0.88, number-average molecular weight of 375 and maximum molecular weight of 820. The starting oil had a saturated hydrocarbon content of 41.9 wt. %.

1,000 g of the starting oil was charged in a 1.45 l stainless steel reaction device and kept at 430° C. for 1.5 hours under stirring in nitrogen gas stream to obtain 14.2 wt. %, based on the starting oil, of a residual pitch having a softening point of 228° C., specific gravity of 1.32, and quinoline-insoluble matter content of 15 wt. %. The pitch contained about 45% of perfectly spherical, optically anisotropic spheres having a diameter of up to 100 μm in optically isotropic mother phase as revealed by the observation by means of a polarized light microscope. 100 g of the pitch was charged in an about 300 ml cylindrical glass vessel and maintained therein at 360° C. for 30 minutes in nitrogen atmosphere without stirring. After allowing to cool, the glass vessel was broken and the pitch was taken out. It was recognized macroscopically from a difference in gloss that the pitch was divided into upper and lower layers clearly. A mass of the upper layer pitch could be separated out from a mass of the lower layer pitch. The lower layer pitch was obtained in an amount of about 35 g. It was revealed by the observation by means of a polarized light microscope that the upper layer pitch comprised a major proportion of optically isotropic pitch containing about 25% of optically anisotropic spheres having a diameter of up to 50 μm and that the lower layer pitch comprised a major proportion of optically anisotropic pitch containing about 20% of optically isotropic spheres having a diameter of about 50 μm, i.e. a pitch having an optically anisotropic phase content of about 80%. Then, the lower layer pitch was charged in a 50 ml glass vessel and heat-treated at 400° C. for 30 minutes under stirring to obtain about 34 g of a pitch. The pitch had a softening point of 258° C., component O content of 4 wt. %, component A content of 32 wt. %, component B content of 28 wt. %, component C content of 36 wt. % and optically anisotropic phase content of above about 95%.

Then, the pitch was charged in a spinning machine having a nozzle of a diameter of 0.5 mm, molten at 340° C. and extruded through the nozzle under a nitrogen pressure of 100 mmHg and the fiber was rolled round a bobbin rotating at a high speed. At a taking-up speed of 500 m/min., a pitch fiber having a diameter of 8-12 μm was obtained and fiber breaking was hardly observed. A part of the pitch ifber was maintained at 230° C. for one hour in oxygen atmosphere, heated to 1500° C. at a temperature-elevation rate of 30° C./min. in nitrogen gas and then cooled immediately thereafter to obtain a carbon fiber. The carbon fiber had a tensile strength of about 3 GPa and a tensile modulus of about $2.2\times10^2$ GPa.

EXAMPLE 7

A heavy oil mainly comprising components having a boiling point of 250°-540° C. by-produced in the refining step of petroleum was filtrated through a filter at 80° C. to remove chloroform-insoluble matter therefrom. The oil was the same as that used in Example 3 and had a carbon content of 89.3 wt. %, hydrogen content of 8.7 wt. %, sulfur content of 2.2 wt. % and specific gravity of 1.04. 1,000 g of the starting oil was charged in a 1.45 l stainless steel reaction device and kept at 415° C. for three hours under stirring in nitrogen gas stream to effect the thermal cracking and polycondensation reaction. Thus, 9.1 wt. %, based on the starting material, of a pitch residue was obtained. It had a softening point of 236° C., specific gravity of 1.32 and quinoline-insoluble matter (component C) content of 12 wt. % and contained about 50% of perfectly spherical, optically anisotropic globules having a diameter of up to 200 μm in the optically isotropic mother phase as revealed by the observation by means of a polarized light microscope. Then, the pitch was charged in a cylindrical vessel having an inner diameter of 4 cm and a length of 20 cm and provided with a drawing cock at the bottom and maintained at 360° C. for 30 minutes under stirring at 15 r.p.m. under nitrogen atmosphere. Then, the cock at the bottom of the reaction vessel was opened under an elevated nitrogen pressure of 100 mmHg to allow a slightly viscous, lower pitch layer to flow slowly downwards, which was collected in a vessel in which nitrogen gas was passed. The flowing was continued until the viscosity of the pitch was lowered remarkably to obtain the lower pitch layer in a yield of about 48 wt. % based on the charged amount. Thereafter, the upper layer pitch remaining in the vessel was allowed to flow down and collected in another vessel. Yield of the upper layer pitch was about 51 wt. % based on the charged amount. The upper layer pitch comprised mainly optically isotropic phase containing about 20% of perfectly spherical, optically anisotropic spheres having a diameter of up to 20μ. The lower layer pitch comprised mainly optically anisotropic phase containing 15-20% of the isotropic phase and having a large flow pattern. The lower layer pitch was heat-treated at 390° C. for about 30 minutes under stirring in a 50 ml reaction vessel in nitrogen atmosphere. Thus obtained pitch will be referred to as Sample 9. The lower layer pitch was also heat-treated under the same conditions as above for about 50 minutes to obtain a pitch which will be referred to as Sample 10. By the observation by means of a polarizing microscope, it was found that Sample 10 comprised a complete, optically anisotropic phase having a softening point of about 259° C. Sample 9 was a substantially optically anisotropic pitch still containing about 5% of optically isotropic phase in the form of fine spheres and having a softening point of 255° C.

Each of the pitches (Samples 9 and 10) was charged in a spinning machine having a nozzle of a diameter of 0.5 mm, molten at a temperature of around 350° C. and extruded under a nitrogen pressure of below 200 mmHg. The fiber was taken up round a bobbin rotating at a high speed. In both cases, pitch fibers having a diameter of 8-10 μm could be obtained continuously for a long period of time at a high speed of 500 m/min. with only a low breaking frequency. The pitch fibers produced from Samples 9 and 10 were infusibilized and carbonized in the same manner as in Example 1. They had an average tensile strength of about 3 GPa and an average tensile modulus of about $3\times10^2$ GPa.

EXAMPLE 8

Each of Samples 2-7 obtained as above was charged in a spinning machine having a nozzle of a diameter of 0.5 mm. The temperature was elevated and the pitch was extruded under stirring under a nitrogen gas pressure of up to 200 mmHg while an optimum melt spinning temperature was watched. The fiber was taken up by means of a bobbin placed below to obtain a pitch fiber. Then, the pitch fiber was maintained at 230° C. for 30 minutes in oxygen stream to make the same infusible. The fiber was heated to 1500° C. at a temperature elevation rate of 30° C./min in an insert gas atmosphere and then allowed to cook to obtain a carbon fiber. Spinning properties of the samples and properties of the carbon fibers are summarized in Table 1.

TABLE 1

PITCH SPINNING AND PROPERTIES OF CARBON FIBERS

| | Pitch Properties before Spinning | | | | | Spinning Conditions | | | Frequency of Yarn Breaking |
|---|---|---|---|---|---|---|---|---|---|
| Pitch Sample No. | Soft.Pt. (°C.) | Component O (wt %) | Component A (wt %) | Component B (wt %) | Component C (wt %) | Temp. (°C.) | Velocity (m/min.) | Time (min.) | (Times/ 10 min.) |
| 1 - 1 | 256 | 6 | 32 | 28 | 34 | 340 | 500 | 10 | Less than 1 |
| Example 1 | | | | | | | | 60 | Less than 1 |
| (Present | | | | | | | | 180 | Less than 1 |
| Invention) | | | | | | | | | |
| 1 - 2 | 302 | 2 | 18 | 21 | 57 | 375 | 500 | 10 | Less than 1 |

TABLE 1-continued

PITCH SPINNING AND PROPERTIES OF CARBON FIBERS

| | | | | | | | | | |
|---|---|---|---|---|---|---|---|---|---|
| Example 1 (Present Invention) | | | | | | | | 60<br>180 | Less than 1<br>3 |
| 2 Comparative Example 1 | 335 | 19 | 22 | 45 | 14 | 405 | 300 | 10<br>60<br>— | 8<br>More than 20 |
| 3 Example 2 (Present Invention) | 285 | 3 | 28 | 27 | 42 | 360 | 500 | 10<br>60<br>180 | Less than 1<br>Less than 1<br>1 |
| 4 Example 3 (Present Invention) | 268 | 12 | 29 | 25 | 35 | 360 | 500 | 10<br>60<br>180 | Less than 1<br>Less than 1<br>Less than 1 |
| 5 Comparative Example 2 | 355 | — | — | — | 47 | Could not be spun | | | — |
| 6 Example 4 (Present Invention) | 264 | 4 | 24 | 34 | 38 | 345 | 500 | 10<br>120 | Less than 1<br>Less than 1 |
| 7 Example 5 (Present Invention) | 272 | 6 | 26 | 20 | 48 | 370 | 500 | 10<br>60<br>180 | Less than 1<br>Less than 1<br>Less than 2 |

| | Pitch Properties after Spinning | | Carbon Fiber Properties (Average of 16 Samples) | | |
|---|---|---|---|---|---|
| Pitch Sample No. | Soft.Pt. (°C.) | Amount Undissolved of Quinoline (wt %) | Diameter (μ) | Tensile Strength (GPa) | Modulus of Tensile Elasticity ($10^2$ GPa) |
| 1 - 1 | — | — | 8.1 | 4.1 | 3.6 |
| Example 1 | — | — | 7.9 | 3.6 | 3.4 |
| (Present Invention) | 256 | 34 | 8.8 | 3.4 | 2.6 |
| 1 - 2 | — | — | 10.5 | 2.6 | 2.1 |
| Example 1 | — | — | 11.0 | 2.4 | 2.2 |
| (Present Invention) | 320 | 59 | 10.2 | 2.4 | 2.2 |
| 2 | — | — | 12.5 | 1.3 | 0.7 |
| Comparative Example 1 | 345 | 17 | 14.5 | 0.8 | 0.6 |
| 3 | — | — | 9.5 | 3.2 | 3.1 |
| Example 2 | — | — | 8.6 | 3.4 | 2.8 |
| (Present Invention) | 287 | 44 | 10.4 | 2.6 | 2.3 |
| 4 | — | — | 7.8 | 3.6 | 3.2 |
| Example 3 | — | — | 7.9 | 4.2 | 3.7 |
| (Present Invention) | 275 | 48 | 8.6 | 3.4 | 2.7 |
| 5 Comparative Example 2 | — | — | — | — | — |
| 6 | — | — | 7.5 | 4.0 | 3.6 |
| Example 4 (Present Invention) | 265 | 39 | 8.2 | 3.5 | 2.9 |
| 7 | — | — | 9.8 | 2.8 | 2.9 |
| Example 5 | — | — | 9.7 | 3.2 | 3.0 |
| (Present Invention) | 297 | 53 | 10.4 | 2.8 | 2.6 |

The results of Samples 1, 3, 4, 6 and 7 obtained by the process of the present invention were excellent. Sample 5 which is not included in the present invention could not be spun at any temperature. Sample 2 could not be spun at a temperature of below 380° C. Sample 2 could be spun only a little at 405° C. at a speed of 300 m/min. However, the carbon fiber thus obtained had inferior properties.

Having thus described the invention, what is desired to be protected by Letters Patent is presented by the following appended claims.

What is claimed is:

1. A process for producing a homogeneous, optically anisotropic carbonaceous pitch having a softening point in the range from about 230° C. to about 320° C. and an optically anisotropic phase content of about 90% to about 100% comprising:

providing a carbonaceous material selected from oils and tars capable of forming a pitch when heated at elevated temperatures, said carbonaceous material having a boiling point in the range of about 250° C. to about 540° C. and being substantially free of chloroform and of n-heptane insoluble matter and containing a n-heptane-soluble material, said n-heptane-soluble material consisting essentially of an aromatic oil and resin, each of which has an aromatic carbon fraction of at least 0.6, a number-average molecular weight of up to 1000 and a maximum molecular weight of up to 2000;

heating said carbonaceous material at a temperature in the range of about 380° C. to about 440° C. for a time sufficient to about 20% to about 80% of an optically anisotropic phase;

maintaining said heated carbonaceous material at a temperature in the range from about 360° C. to about 380° C. for a time sufficient to form two layers, an upper layer containing a relatively low optically anisotropic phase content and a lower layer containing relatively high optically anisotropic phase content;

separating said lower layer from said upper layer;

thereafter heating said separated lower layer at a temperature in the range of 380° C. to about 440° C. for a time sufficient to increase the optically anisotropic phase content of said lower layer to at least 90% whereby a homogeneous optically anisotrophic carbonaceous pitch having a softening point in the range of about 230° C. to about 320° C. and an optically anisotropic phase content of about 90% to about 100% is obtained.

2. The process of claim 1 wherein said carbonaceous material is heated at temperatures in the range of 380° C. to 440° C. at pressures in the range of about 2 to about 50 kg/cm$^2$ until the optically anisotropic phase in said heated carbonaceous material is in the range of about 20% to 80% and thereafter said heated carbonaceous material is sparged with nitrogen for a time sufficient to remove components of the heated carbonaceous material which are volatile under sparging conditions.

3. The process according to claim 2, wherein the aromatic carbon fraction of each of the aromatic oil and resin components is at least 0.7.

4. The process according to claim 2, wherein the aromatic oil and resin have a number-average molecular weight of up to 750 and a maximum molecular weight of up to 1,500.

5. The process according to claim 3, wherein the aromatic oil and resin have a number-average molecular weight in the range of 250–750 and a maximum molecular weight of up to 1,500.

6. The process for producing a homogeneous, optically anisotropic carbonaceous pitch having a softening point in the range of about 230° C. to about 320° C. and an optically anisotropic phase content of about 90% to about 100% comprising:

providing a carbonaceous material selected from oils and tars capable of forming a pitch when heated at elevated temperatures, said carbonaceous material being substantially free of chloroform insoluble materials, having up to 1 wt. % of asphaltene as a n-heptane insoluble component and including a mixture of compounds consisting mainly of carbon and hydrogen having a boiling point in the range of about 250° C. to about 540° C. and containing n-heptane-soluble components consisting essentially of an aromatic oil and resin, said aromatic oil and resin each having an aromatic carbon fraction of at least 0.6, a number-average molecular weight of up to 1000 and a maximum molecular weight of up to 2000;

heating said carbonaceous material at temperatures in the range from about 380° C. to about 440° C. for a time sufficient to 20% to about 80% of an optically anisotrophic phase;

maintaining said heated carbonaceous material at temperatures in the range from about 360° C. to about 380° C. for a time sufficient for said heated carbonaceous material to form an upper layer and a lower layer;

separation said lower layer from said upper layer; and heating said lower layer at a temperature in the range from about 380° C. to about 440° C. for a time sufficient to increase the optical anisotropic phase content of said lower layer to at least 90%.

7. The process according to claim 6, wherein asphaltene has an aromatic carbon fraction of at least 0.6, number-average molecular weight of up to 1,000 and a maximum molecular weight of up to 2,000.

8. The process according to claim 7, wherein the aromatic oil, resin and asphaltene each have an aromatic carbon fraction of at least 0.7.

9. The process according to claim 7, wherein the aromatic oil, resin and asphaltene each have a number-average molecular weight of up to 750 and a maximum molecular weight of up to 1,500.

10. The process according to claim 9, wherein the aromatic oil, resin and asphaltene each have a number-average molecular weight in the approximate range of 250–750 and a maximum molecular weight of up to 1,500.

11. A homogeneous, optically anisotropic carbonaceous pitch having a softening point in the approximate range of 230°–320° C. and an optically anisotropic phase content of approximately 90–100%, and used for the production of carbon materials derived from a starting material comprising a substantially chloroform-insoluble matter-free oily or tarry substance including a mixture of compounds consisting mainly of carbon and hydrogen having a boiling point in the approximate range of 250°–540° C. and containing an aromatic oil and resin as the main n-heptane-soluble components, in which the aromatic oil and resin each have an aromatic carbon fraction of at least 0.6, a number-average molecular weight of up to 1000 and a maximum molecular weight of up to 2000 wherein said starting material is subjected to a thermal cracking and polycondensation reaction to form approximately 20–80% of optically anisotropic phase pitch and comprising the additional process steps of allowing the pitch to settle at a temperature of approximately 350°–400° C. in order to deposit an optically aniostropic phase in a bottom layer and separating said optically anisotropic phase from an upper layer containing an optically isotropic phase.

12. The optically anisotropic pitch of claim 11, wherein said aromatic oil and resin each have an aromatic carbon fraction of at least 0.7.

13. The optically anisotropic pitch of claim 11, wherein the aromatic oil and resin each have a number-average molecular weight of up to 750 and a maximum molecular weight of up to 1,500.

14. The optically anisotropic pitch of claim 13, wherein the aromatic oil and resin each have a number-average molecular weight in the approximate range of 250–750 and a maximum molecular weight of up to 1,500.

15. The optically anisotropic pitch of claim 11, wherein the thermal cracking and polycondensation reaction are carried out at a temperature in the approximate range of 380°–460° C.

16. A process for producing a homogeneous, optically anisotropic carbonaceous pitch having a softening point in the approximate range of 230°–320° C. and an optically anisotropic phase content of approximately 90–100%, and used for the production of carbon materials comprising the steps of: subjecting a starting material to a thermal cracking and polycondensation reaction to form approximately 20–80% of optically anisotropic phase pitch said starting material including a substantially chloroform-insoluble matter-free oily or tarry substance comprising a mixture of compounds consisting mainly of carbon and hydrogen having a boiling point in the approximate range of 250°–540° C. and containing an aromatic oil and resin as main n-heptane-soluble components, in which the aromatic oil and resin each have an aromatic carbon fraction of at least 0.6, a number-average molecular weight of up to 1,000 and a maximum molecular weight of up to 2,000; allowing said pitch to settle at a temperature of up to 400° C. to deposit an optically anisotropic phase in a bottom layer; separating said bottom layer from an upper layer containing optically isotropic phase; and heat-treating said bottom layer containing said optically anisotropic phase to obtain an optically anisotropic phase content of more than 90%.

17. The process according to claim 16, wherein said thermal decomposition and polycondensation reaction are carried out at a temperature of at least 380° C. and said heat treatment is carried out also at a temperature of at least 380° C.

18. The process according to claim 16, wherein said thermal decomposition and polycondensation reaction are carried out at a temperature in the approximate range of 400°–440° C.

19. The process according to claim 16, wherein said lower layer separates out at a temperature in the approximate range of 360°–380° C. and has an optically anisotropic phase content of about 70–90%.

20. The process according to claim 16, wherein said heat treatment is carried out at approximately 390°–440° C.

21. The process according to claim 16, wherein the aromatic oil and resin each have an aromatic carbon fraction of at least 0.7.

22. The process according to claim 16, wherein said aromatic oil and resin each have a number-average molecular weight of up to 750 and a maximum molecular weight of up to 1,500.

23. The process according to claim 21, wherein the aromatic oil and resin each have a number-average molecular weight in the approximate range of 250–750 and a maximum molecular weight of up to 1,500.

24. The process for producing a homogeneous, optically anisotropic carbonaceous pitch having a softening point in the approximate range of 230°–320° C. and an optically anisotropic phase content of approximately 90–100%, and used for the production of carbon materials using as a starting oil a substantially chloroform-insoluble matter-free oily or tarry substance comprising a mixture of compounds consisting mainly of carbon and hydrogen having a boiling point in the approximate range of 250°–540° C. and containing an aromatic oil and resin as n-heptane-soluble components and asphaltene as a n-heptane-insoluble component, in which the aromatic oil and resin each have an aromatic carbon fraction of at least 0.6, a number-average molecular weight of up to 1,000 and a maximum molecular weight of up to 2,000; the process comprising the steps of: subjecting said starting oil to a thermal cracking and polycondensation reaction to form approximately 20–80% of optically anisotropic phase pitch; allowing said pitch to settle at a temperature of approximately 350°–400° C. to deposit an optically anisotropic phase in a bottom layer; and separating said bottom layer from an upper layer containing an optically isotropic phase and heat-treating said bottom layer to obtain an optically anisotropic phase content of more than 90%.

25. The process according to claim 24, wherein the asphaltene has an aromatic carbon fraction of at least 0.6, a number-average molecular weight of up to 1,000 and a maximum molecular weight of up to 2,000.

26. The process according to claim 24, wherein the aromatic oil, resin and asphaltene each have an aromatic carbon fraction of at least 0.7.

27. The process according to claim 24, wherein the aromatic oil, resin and asphaltene each have a number-average molecular weight of up to 750 and a maximum molecular weight of up to 1,500.

28. The process according to claim 27, wherein the aromatic oil, resin and asphaltene each have a number-average molecular weight in the approximate range of 250–750 and a maximum molecular weight of up to 1,500.

29. The process according to claim 24, wherein said thermal cracking and polycondensation reaction are carried out at a temperature in the approximate range of 380°–460° C.

30. The process for producing a homogeneous, optically anisotropic carbonaceous pitch having a softening point in the approximate range of 230°–320° C. and an optically anisotropic phase content of approximately 90–100%, and used for the production of carbon materials using as a starting oil a substantially chloroform-insoluble matter-free oily or tarry substance comprising a mixture of compounds consisting mainly of carbon and hydrogen having a boiling point in the approximate range of 250°–540° C., and containing an aromatic oil and resin as n-heptane-soluble components and asphaltene as a n-heptane-insoluble component, in which the aromatic oil and resin each have an aromatic carbon fraction of at least 0.6, a number-average molecular weight of up to 1,000 and a maximum molecular weight of up to 2,000; the process comprising the steps of: subjecting said starting material to a thermal cracking and polycondensation reaction to form approximately 20–80% of optically anisotropic phase pitch; allowing said pitch to settle at a temperature of up to 400° C. in order to deposit an optically anisotropic phase in a bottom layer; separating said bottom layer from said upper level containing an optically isotropic phase; and heat-treating said bottom layer to obtain an optically anisotropic phase content of more than 90%.

31. The process according to claim 30, wherein said thermal cracking and polycondensation reaction are carried out at a temperature of at least 380° C. and said heat treatment is carried out also at a temperature of at least 380° C.

32. The process according to claim 30, wherein said thermal cracking and polycondensation reaction are carried out at a temperature in the approximate range of 400°–440° C.

33. The process according to claim 30, wherein the lower layer separated out at a temperature in the approximate range of 360°–380° C. having an optically anisotropic phase content of about 70–90%.

34. The process according to claim 30, wherein said heat treatment is carried out at approximately 390°–440° C.

35. The process according to claim 30, wherein the asphaltene has an aromatic carbon fraction of at least 0.6, a number-average molecular weight of up to 1,000 and a maximum molecular weight of up to 2,000.

36. The process according to claim 35, wherein said aromatic oil, resin and asphaltene each have an aromatic carbon fraction of at least 0.7.

37. The process according to claim 35, wherein the aromatic oil, resin and asphaltene each have a number-average molecular weight of up to 750 and a maximum molecular weight of up to 1,500.

38. The process according to claim 36, wherein the aromatic oil, resin and asphaltene each have a number-average molecular weight in the approximate range of 250–750 and a maximum molecular weight of up to 1,500.

* * * * *

UNITED STATES PATENT AND TRADEMARK OFFICE

CERTIFICATE OF CORRECTION

PATENT NO. : 4,454,019

DATED : June 12, 1984

INVENTOR(S) : Takayuki Izumi et al

It is certified that error appears in the above-identified patent and that said Letters Patent is hereby corrected as shown below:

On the face of the patent immediately below "[22] Filed: Jan. 11, 1982", insert --[30] Foreign Application Priority Date Jan. 28, 1981 Japan [JP] ..... 111 24/81--.

Signed and Sealed this

*Twenty-third* Day of *October 1984*

[SEAL]

*Attest:*

GERALD J. MOSSINGHOFF

*Attesting Officer*

*Commissioner of Patents and Trademarks*